US009193549B2

(12) United States Patent
Fumoto

(10) Patent No.: US 9,193,549 B2
(45) Date of Patent: Nov. 24, 2015

(54) SHEET CONVEYING APPARATUS AND IMAGE FORMING APPARATUS

(71) Applicant: CANON KABUSHIKI KAISHA, Tokyo (JP)

(72) Inventor: Masataka Fumoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/576,582

(22) Filed: Dec. 19, 2014

(65) Prior Publication Data

US 2015/0191324 A1 Jul. 9, 2015

(30) Foreign Application Priority Data

Jan. 7, 2014 (JP) ..... 2014-000888

(51) Int. Cl.

| | |
|---|---|
| ***B65H 9/06*** | (2006.01) |
| ***B65H 9/00*** | (2006.01) |
| ***B65H 5/06*** | (2006.01) |
| ***B65H 5/36*** | (2006.01) |
| ***B65H 7/20*** | (2006.01) |
| ***B65H 29/70*** | (2006.01) |

(52) U.S. Cl.

CPC ..... *B65H 9/002* (2013.01); *B65H 5/068* (2013.01); *B65H 5/36* (2013.01); *B65H 7/20* (2013.01); *B65H 9/004* (2013.01); *B65H 9/06* (2013.01); *B65H 29/70* (2013.01)

(58) Field of Classification Search

CPC ..... B65H 9/06; B65H 9/004; B65H 5/36

See application file for complete search history.

(56) References Cited

U.S. PATENT DOCUMENTS

2013/0193639 A1* 8/2013 Kataoka ..... 271/245

FOREIGN PATENT DOCUMENTS

JP 2006-341993 A 12/2006
JP 4617208 B2 1/2011

* cited by examiner

*Primary Examiner* — Luis A Gonzalez

(74) *Attorney, Agent, or Firm* — Fitzpatrick, Cella, Harper & Scinto

(57) ABSTRACT

The invention relates to a sheet conveying apparatus which includes: a rotator pair which includes a nip portion to nip and convey a sheet conveyed by a sheet conveying portion; a first moving portion which includes a first contact surface abutting on the sheet on an upstream of the nip portion of the rotator pair in a sheet conveying direction, the first contact surface moving while being pressed by the sheet; a second moving portion which includes a second contact surface abutting on the sheet on the upstream of the nip portion of the rotator pair in the sheet conveying direction, the second contact surface moving while being pressed by the sheet; and a guide portion which guides a leading edge of the sheet conveyed by the sheet conveying portion selectively to the first contact surface of the first moving portion and the second contact surface of the second moving portion.

20 Claims, 13 Drawing Sheets

SHEET CONVEYING APPARATUS AND IMAGE FORMING APPARATUS

BACKGROUND OF THE INVENTION

1. Field of the Invention

The present invention relates to a sheet conveying apparatus which can correct skew feeding of a sheet and an image forming apparatus including the same.

2. Description of the Related Art

In an image forming apparatus such as a copying machine, a printer, a facsimile, and a multifunction peripheral thereof, the accuracy of an image geometrical characteristic with respect to a sheet is one of important elements affecting image quality, and is degraded when the sheet is fed on the skew. Therefore, in a conventional image forming apparatus, a skew correction unit is provided in a sheet conveying apparatus which conveys the sheet to an image forming portion, and the skew feeding of the sheet is corrected by the skew correction unit in order to prevent the degradation in accuracy of the image geometrical characteristic.

As the skew correction unit described above, there is generally known a shutter system in which a leading edge of a conveying sheet is abutted to align the leading edge of the sheet in a width direction perpendicular to a sheet conveying direction to correct the skew feeding of the sheet. Since the shutter system does not need a driving control system for correcting the skew feeding of the sheet, this system has a great merit on cost.

On the other hand, since the shutter system is configured to move the sheet corrected in skew feeding by rotating a shutter member with a rigidity (stiffness) of the sheet after the leading edge of the sheet is aligned in the width direction, the type of the sheet to be corrected in skew feeding is limited. For example, in the case of a low rigidity sheet (a thin sheet), the sheet is not possible to rotate the shutter and thus may cause a paper jam. In addition, since an apparent rigidity of the sheet is reduced even under a high humidity environment, the same situation may occur.

In this regard, there is disclosed an image forming apparatus which can adjust the contact position of the sheet with respect to the shutter member and make the sheet approach a nip of a conveying roller pair as the rigidity of the sheet is lowered, so that the shutter member is rotatable by a small urging force (see Japanese Patent Laid-Open No. 2006-341993).

However, since the image forming apparatus disclosed in Japanese Patent Laid-Open No. 2006-341993 is configured to change the contact position of the shutter member in cooperation with an opening and closing operation of a manual feeding portion, there is a need to feed the sheet from the manual feeding portion depending on the type of the sheet. The action of setting the sheet on the manual feeding portion is troublesome for a user, and thus the image forming apparatus lacks usability.

Therefore, it is desirable to provide a sheet conveying apparatus and an image forming apparatus having the same which can correct the skew feeding of the sheet with simplicity and ease regardless of the type of the sheet.

SUMMARY OF THE INVENTION

The invention is to provide a sheet conveying apparatus including: a rotator pair which includes a nip portion to nip and convey a sheet conveyed by a sheet conveying portion; a first moving portion which includes a first contact surface abutting on the sheet on an upstream of the nip portion of the rotator pair in a sheet conveying direction, the first contact surface moving while being pressed by the sheet; a second moving portion which includes a second contact surface abutting on the sheet on the upstream of the nip portion of the rotator pair in the sheet conveying direction, the second contact surface moving while being pressed by the sheet; and a guide portion which guides a leading edge of the sheet conveyed by the sheet conveying portion selectively to the first contact surface of the first moving portion and the second contact surface of the second moving portion.

Further features of the present invention will become apparent from the following description of exemplary embodiments with reference to the attached drawings.

DESCRIPTION OF THE EMBODIMENTS

Hereinafter, an image forming apparatus according to embodiments of the invention will be described with reference to the drawings. The image forming apparatus according to the embodiments of the invention is an image forming apparatus, such as a copying machine, a printer, a facsimile, and a multifunction peripheral thereof, including a sheet conveying portion as a sheet conveying apparatus which can convey the sheet while correcting a skew feeding of the sheet. In the following embodiments, the image forming apparatus will be described using a laser beam printer of an electrophotographic system (hereinafter, referred to as a "printer") 1.

<First Embodiment>

Figure 1:
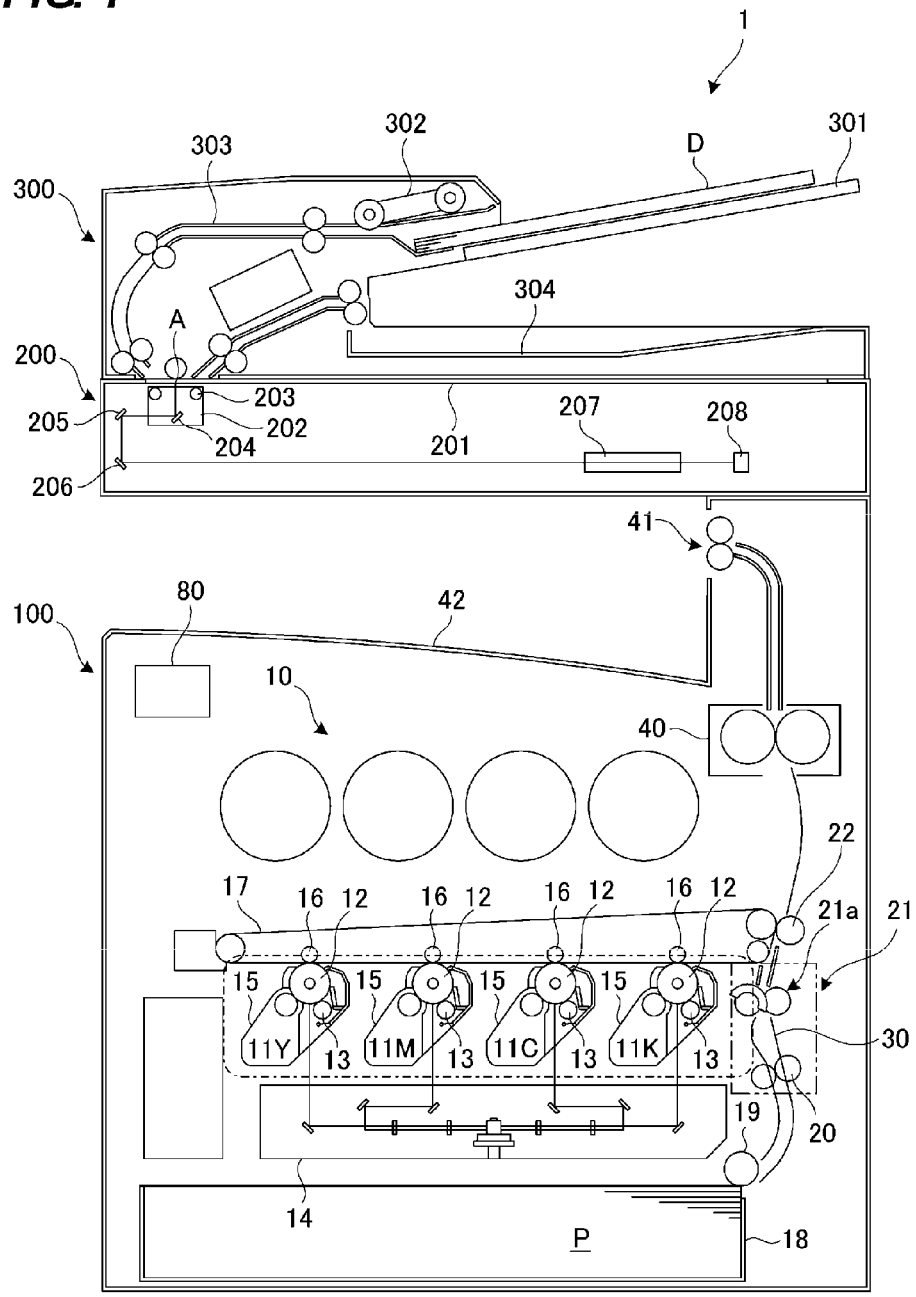
FIG. 1 is a cross-sectional view schematically illustrating a printer according to a first embodiment of the invention.

A printer 1 according to the first embodiment of the invention will be described with reference to FIGS. 1 to 10. First, a schematic configuration of the printer 1 will be described along a flow of a sheet P with reference to FIG. 1. FIG. 1 is a cross-sectional view schematically illustrating the printer 1 according to the first embodiment of the invention.

As illustrated in FIG. 1, the printer 1 includes a printer body 100 which forms an image on the sheet P, an image reading apparatus 200 which can read image information out of an original D, and an original feeding apparatus 300 which can automatically feed the original D to a predetermined image reading position A. In addition, the printer 1 includes a controller 80 which controls the printer body 100, the image reading apparatus 200, and the original feeding apparatus 300. Further, the printer 1 according to the embodiment is configured such that the image reading apparatus 200 is disposed above the printer body 100 and the sheet P with an image formed therein is discharged to a space between the printer body 100 and the image reading apparatus 200.

The original feeding apparatus 300 is disposed above the image reading apparatus 200, and feeds the originals D set on an original tray 301 one by one using an original feeding unit 302. In addition, the original feeding apparatus 300 conveys the original D fed by the original feeding unit 302 to pass through the image reading position A on a platen glass 201 of the image reading apparatus 200 via a bent feeding path 303, and discharges the original D to an original discharge portion 304.

The image reading apparatus 200 reads the image information of the original D by a scanner unit 202 held below the image reading position A when the original D fed by the original feeding apparatus 300 passes through the image reading position A. Specifically, the image reading apparatus 200 irradiates a reading surface of the original D moving on the image reading position A using a light source 203 of the scanner unit 202, and guides a reflected light from the original D to a lens 207 through mirrors 204, 205, and 206. Then, the light passing through the lens 207 is formed as an image on an imaging surface of an image sensor 208, and converted into a digital signal, and then transmitted to an image forming portion 10 of the printer body 100.

In addition, the image reading apparatus 200 can read the image information of the original D even by making the scanner unit 202 scan the original D while moving the scanner unit 202 in a state where the original D is directly set (mounted) on the platen glass 201. In other words, the printer 1 is not necessary to include the original feeding apparatus 300. In a case where the original feeding apparatus 300 is not included, an original pressing member may be provided to press the original D on the platen glass 201.

The printer body 100 includes the image forming portion 10 which forms an image on the sheet P and a sheet feeding portion which feeds the sheet P to the image forming portion 10. The image forming portion 10 includes process cartridges 11Y to 11K of Y (yellow), M (magenta), C (cyan), K (black), and each of the process cartridges 11Y to 11K has a photosensitive drum 12. The surface of the photosensitive drum 12 is evenly charged by a charging roller 13, and an electrostatic latent image is formed thereon by a laser scanner 14 based on the transmitted digital signal. The electrostatic latent image is actualized by a development device 15, and is transferred onto an intermediate transfer belt 17 by exerting a predetermined pressing force and an electrostatic bias to a primary transfer roller 16. Further, a less residual toner left on the photosensitive drum 12 after the transfer is removed and collected by a cleaner, and is prepared for the next image forming operation.

In parallel with the above-mentioned image forming operation, a feeding unit 19 separates and feeds the sheets P contained in a sheet cassette 18 one by one. The separated and fed sheet P is conveyed to a sheet conveying portion 21, and is subjected to a skew correction. Further, the sheet conveying portion 21 will be described in detail.

The sheet P corrected in skew feeding is conveyed by the sheet conveying portion 21 to a transfer nipping portion between the intermediate transfer belt 17 and a secondary transfer roller 22 while making the synchronization with a toner image to be transferred to the intermediate transfer belt 17. The toner image on the intermediate transfer belt 17 is transferred onto the sheet P by exerting the predetermined pressing force and the electrostatic bias to the secondary transfer roller 22. Further, a less residual toner left on the intermediate transfer belt 17 after the transfer is removed by a cleaner, and is prepared for the next image forming operation.

The toner image transferred on the sheet P is heated and pressed by a fixing device 40 to be fixed on the sheet P, and discharged to a space between the printer body 100 and the image reading apparatus 200 by a discharge roller pair 41. Then, the sheet P is sequentially stacked on a discharge sheet stacking portion 42 provided in a space between the printer body 100 and the image reading apparatus 200.

Figure 2:
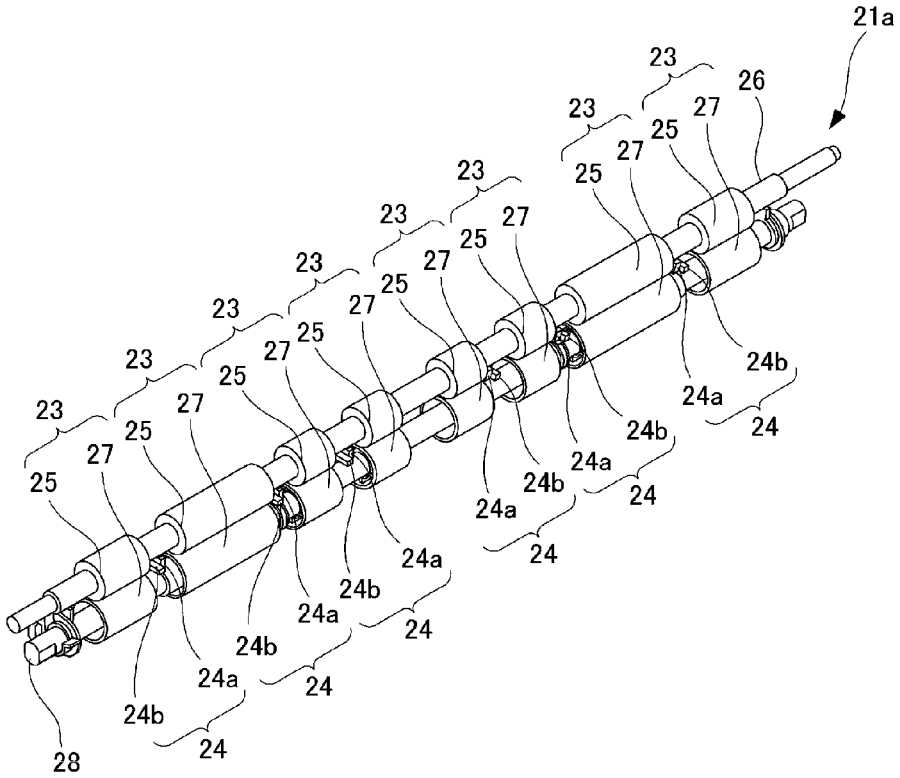
FIG. 2 is a perspective view illustrating a register unit according to the first embodiment.
Figure 3A:
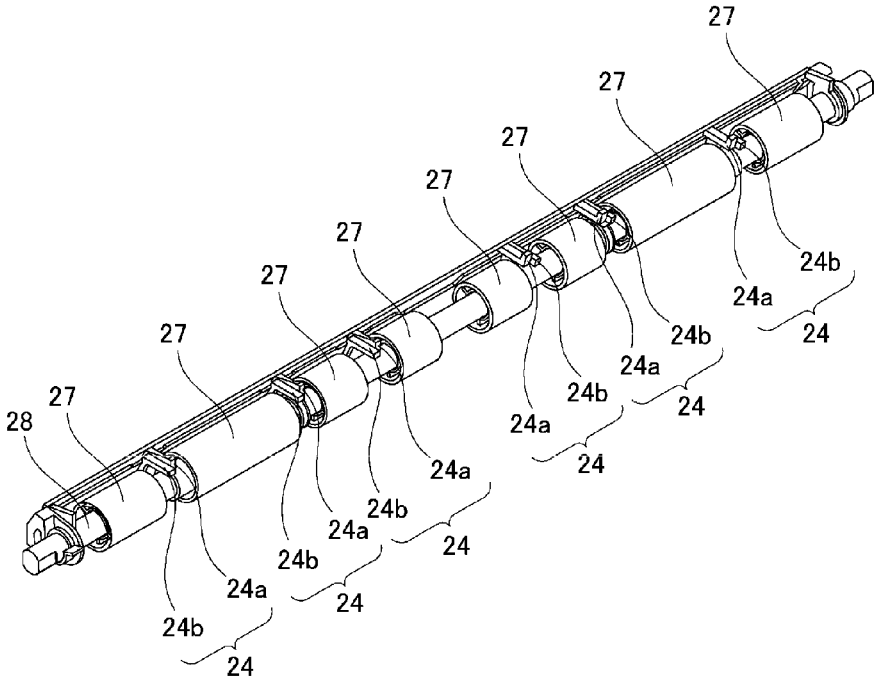
FIGS. 3A and 3B are perspective views illustrating initial positions of a first shutter member and a second shutter member.
Figure 3B:
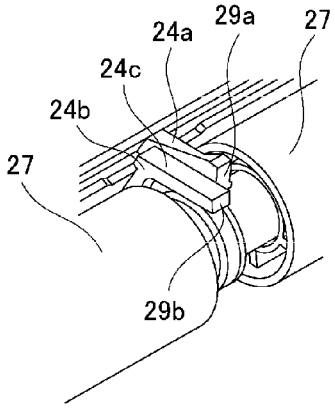
Figure 4:
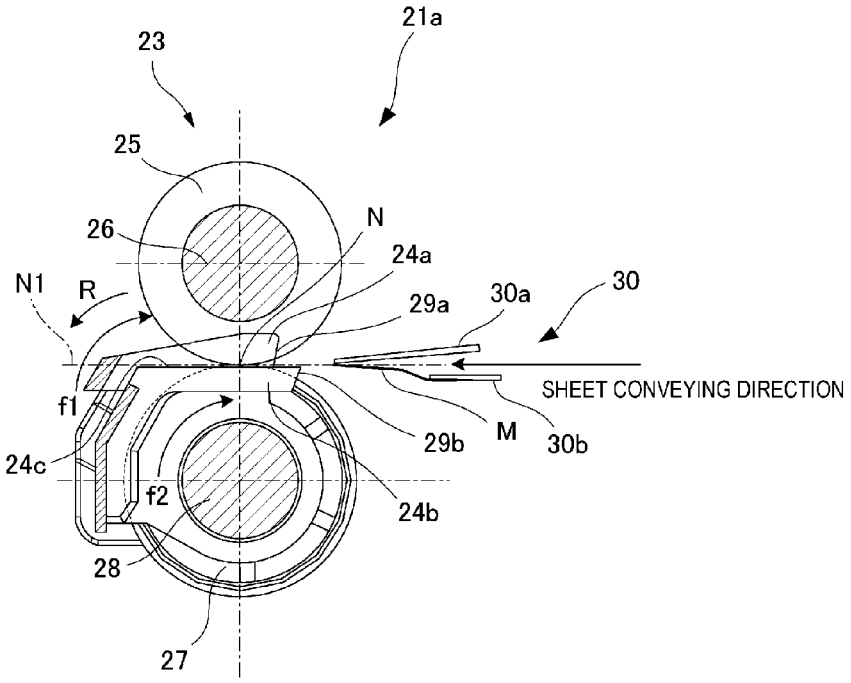
FIG. 4 is a cross-sectional view illustrating the initial positions of the first shutter member and the second shutter member.

Next, the above-mentioned sheet conveying portion 21 will be described with reference to FIGS. 2 to 10 in addition to FIG. 1. First, the schematic configuration of the sheet conveying portion 21 will be described with reference to FIGS. 1 to 4. FIG. 2 is a perspective view illustrating a register unit 21*a* according to the first embodiment. FIGS. 3A and 3B are perspective views illustrating initial positions of a first shutter member (a first moving portion) 24*a* and a second shutter member (a second moving portion) 24*b*. FIG. 4 is a cross-sectional view illustrating the initial positions of the first shutter member 24*a* and the second shutter member 24*b*.

As illustrated in FIG. 1, the sheet conveying portion 21 includes a conveying roller pair (a sheet conveying unit) 20 which conveys the sheet P, and a registration unit (hereinafter, referred to as a "register unit") 21*a* which can correct the skew feeding of the sheet P. In addition, the sheet conveying portion 21 includes a conveying guide (a guide portion) 30 which guides the sheet P to the register unit 21*a*. The conveying roller pair 20 is provided on a downstream in a sheet conveying direction of the feeding unit 19, and conveys the sheets P separately fed one by one out of the feeding unit 19. Further, in the embodiment, the description has been made using the conveying roller pair 20 as the sheet conveying unit, but in a case where the conveying roller pair 20 is not used, the above-mentioned feeding unit 19 serves as the feeding unit for example.

As illustrated in FIG. 2, the register unit (a skew correction unit) 21*a* includes a plurality of registration roller pairs (hereinafter, referred to as a "register roller pair (a rotator pair)") 23 and so on which nip and convey the sheet P and a plurality of skew correction portions 24 and so on which can correct the skew feeding of the sheet P.

Each of the plurality of register roller pairs 23 includes a driving roller 25 which is fixed to a register driving shaft 26 and a driven roller 27 which is fixed to a register driven shaft 28, and the driving roller 25 and the driven roller 27 abut on each other with pressure by an urging unit (not illustrated). In addition, the register driving shaft 26 and the register driven shaft 28 are supported to the frame of the printer body 100 to be freely rotated, and the register driving shaft 26 is connected to a driving motor (not illustrated).

As illustrated in FIG. 3A, each of the plurality of skew correction portions 24 includes the first shutter member 24*a* and the second shutter member 24*b*, and abuts on a leading edge of the sheet P entering a nip portion N (see FIG. 4) of the register roller pair 23 to correct the skew feeding of the sheet P. In addition, each of the plurality of skew correction portions 24 is disposed between the register roller pairs 23 and 23 in a width direction perpendicular to the sheet conveying direction.

The first shutter member 24*a* is rotatably supported to the register driven shaft 28 through an urging spring (not illustrated), and has a position illustrated in FIG. 3B as an initial position. In addition, as illustrated in FIGS. 3B and 4, the first shutter member 24*a* includes a first contact surface 29*a* positioned to cross over a nip line N1 on an upper stream side in the sheet conveying direction from the nip portion N of the register roller pair 23. The first contact surface 29*a* is formed to abut on the conveyed sheet P, the first shutter member 24*a* is configured to rotate in a direction indicated by arrow R against an urging force f1 of the urging spring when the first contact surface 29*a* is pushed by the conveyed sheet P with a force equal to or larger than the urging force f1. While the first shutter member 24*a* rotates in the direction of arrow R, the first contact surface 29*a* is retracted from a contact position (the initial position). Further, the first shutter members 24*a* are configured to be connected to each other, and integrally rotate when being pushed by the sheet P.

In addition, the sheet P is nipped at the nip portion N only by slight rotation of the first shutter member 24*a* when the first contact surface 29*a* is positioned near the nip portion N of the register roller pair 23, for example, when the first contact surface 29*a* is pushed by the sheet P. The above configuration is advantageous in preventing a paper jam of a thin sheet (a low rigidity sheet) when the skew feeding of the thin sheet is corrected.

The second shutter member 24*b* is disposed adjacent to the first shutter member 24*a*, and rotatably supported to the register driven shaft 28 through the urging spring (not illustrated), and the position illustrated in FIG. 3B is the initial position. As the urging spring which applies a force to the second shutter member 24*b*, an urging spring exerting an urging force f2 (f1<f2) stronger than the urging force f1 of the urging spring which applies a force to the first shutter member 24*a* is employed. Further, in the embodiment, the urging force f2 has been set to be larger than the urging force f1 (f1<f2), but the urging force f1 and the urging force f2 may be configured to have the same magnitude (f1=f2).

In addition, as illustrated in FIG. 4, the second shutter member 24*b* includes a second contact surface 29*b* which can abut on the conveyed sheet P on the upper stream side in the sheet conveying direction from the first contact surface 29*a* of the first shutter member 24*a*. In other words, the register unit 21*a* is configured to include the second contact surface 29*b*, the first contact surface 29*a*, and the nip portion N of the register roller pair 23 in this order from the upper stream in the sheet conveying direction. In addition, the second contact surface 29*b* is positioned adjacent to the driven roller 27 (a rotation shaft) from the nip line (which is a line extending from the nip portion N) N1 of the register roller pair 23 so as to abut on the sheet P conveyed toward the driven roller 27. Furthermore, the surface of the second shutter member 24*b* on a side near the nip line becomes a guide surface 24*c* substantially parallel to the nip line N1 when the second contact surface 29*b* is positioned at a contact position (the initial position) capable of abutting on the sheet P. The guide surface 24*c* is formed to guide the sheet P abutting on the first contact surface 29*a* toward the nip portion N of the register roller pair 23.

The second shutter member 24*b* is configured to rotate in the direction of arrow R against the urging force f2 of the urging spring when the second contact surface 29*b* is pressed by the conveyed sheet P with a force equal to or larger than the urging force f2. The second contact surface is retracted from the contact position by the rotation of the second shutter member 24*b* in the direction of arrow R. Further, the second shutter members 24*b* are configured to be connected to each other, and integrally rotate when being pushed by the sheet P.

The conveying guide 30 is disposed between the conveying roller pair 20 and the register unit 21*a*, and guides the leading edge of the sheet P to the first contact surface 29*a* of the first shutter member 24*a* or the second contact surface 29*b* of the second shutter member 24*b* by rigidity (stiffness) of the sheet P. Specifically, the conveying guide 30 includes an upper conveyance guide (a guide member) 30*a* which is disposed on a side near the driving roller 25, a lower conveyance guide 30*b* which is disposed on a side near the driven roller 27, and an elastic sheet M which is connected at the downstream end in the sheet conveying direction of the lower conveyance guide 30*b*.

The upper conveyance guide 30*a* is formed such that the sheet P faces the nip portion N of the register roller pair 23 and a leading edge (the downstream end in the sheet conveying direction) of the guide surface is positioned near the nip line N1. Further, in the embodiment, the upper conveyance guide 30*a* is formed such that the guide surface is inclined downward toward the nip portion N and the leading edge is positioned near the nip line N1, and may be formed such that the leading edge of at least the guide surface is positioned near the nip line N1. The lower conveyance guide 30*b* is disposed on an opposite side (a side near the second shutter member) to the upper conveyance guide 30*a* with respect to the nip line N1.

The elastic sheet M is elastically deformable, and is disposed such that an inter-guide gap with respect to the upper conveyance guide 30*a* is narrowed (constricted) as it goes to the downstream in the sheet conveying direction. In other words, the downstream end in the sheet conveying direction of the elastic sheet M is positioned near the nip line N1, and disposed to guide the sheet P toward the second contact surface 29*b* according to the thickness of the sheet P. In addition, in a case where the rigidity of the sheet P is lower (weak stiffness) than a predetermined rigidity, the elastic sheet M guides the sheet to the nip portion N of the register roller pair 23 without any deforming, and in the case of a high rigidity (strong stiffness) sheet P, the rigidity is adjusted such that the elastic sheet M is pressed by the sheet P and deformed toward the driven roller 27. Further, at this time, a force of the sheet P pressing the elastic sheet M is a force generated by the weight of the sheet P. In other words, in the case of the high rigidity sheet P, when the leading edge of the sheet P reaches the elastic sheet M, the sheet P falls down by its own weight toward the driven roller and abuts on the second contact surface 29*b*.

Since the adjustment is performed as described above, in a case where the thin sheet (the low rigidity sheet) is conveyed, the conveying guide 30 can guide the sheet to the first contact surface 29*a*, and in a case where the thick sheet (the high rigidity sheet) is conveyed, the conveying guide 30 can guide the sheet to the second contact surface 29*b*.

Figure 5A:
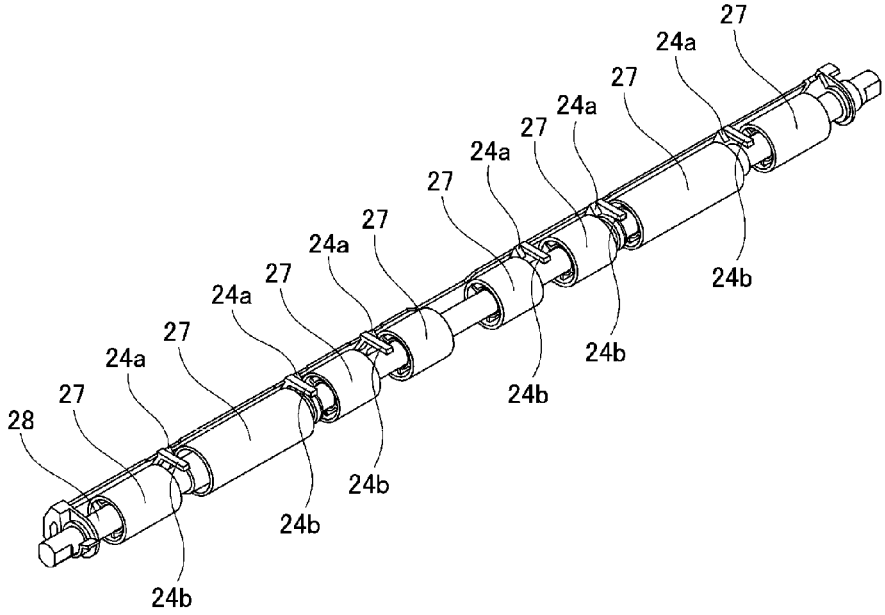
FIGS. 5A and 5B are perspective views illustrating a state in which the first shutter member moves to a retracting position.
Figure 5B:
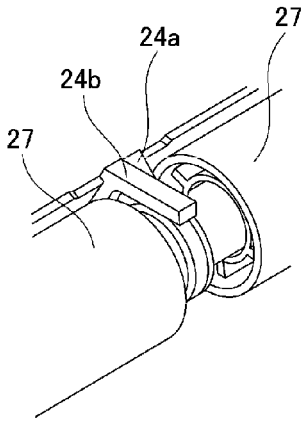
Figure 6A:
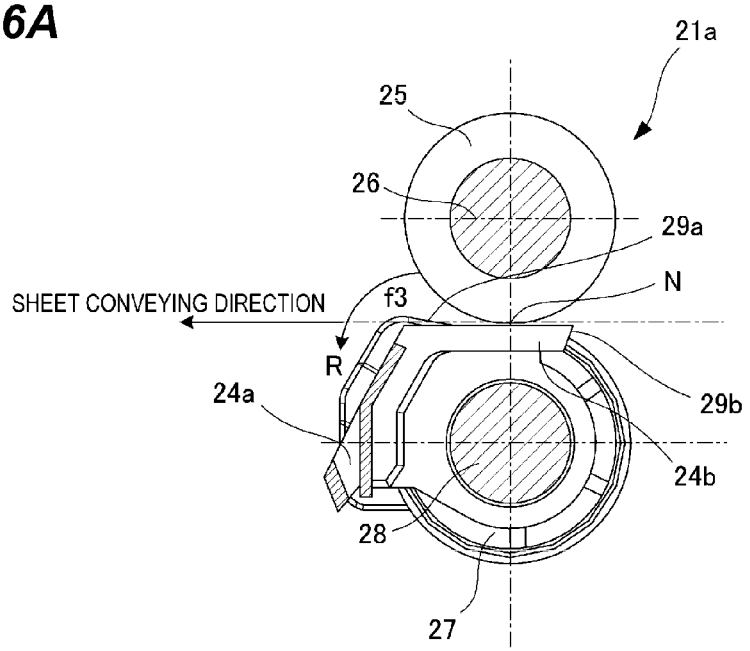
FIGS. 6A and 6B are cross-sectional views illustrating a state in which the first shutter member moves to the retracting position.
Figure 6B:
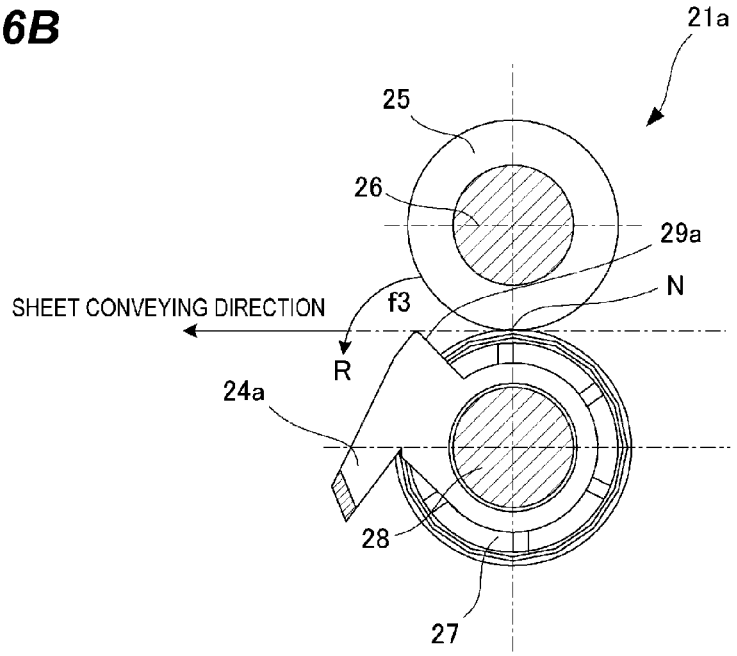

Next, a skew correction operation on the low rigidity (weak stiffness) sheet P and the high rigidity (strong stiffness) sheet P will be specifically described with reference to FIGS. 5A to 10 in addition to FIG. 4. First, the skew correction operation of the low rigidity sheet P will be described with reference to FIGS. 4 to 6B. FIGS. 5A and 5B are perspective views illustrating a state in which the first shutter member 24*a* moves to a retracting position. FIGS. 6A and 6B are cross-sectional views illustrating the state in which the first shutter member 24*a* moves to the retracting position.

As illustrated in FIG. 4, in a case where the sheet P fed to the sheet conveying portion 21 has a rigidity lower than that of plain paper (a basis weight of 100 g/m$^2$), the sheet P conveyed by the conveying roller pair 20 is guided to the nip portion N of the register roller pair 23 from the conveying guide 30. This is because in a case where the rigidity of the sheet P is low (lower than a predetermined rigidity), the elastic sheet M of the conveying guide 30 is not elastically deformed but guides the sheet P toward the nip portion N of the register roller pair 23 in cooperation with the upper conveyance guide 30*a*.

In a case where the sheet P guided toward the nip portion N of the register roller pair 23 is fed on the skew, the sheet P abuts on the first contact surface 29*a* which is disposed at a position corresponding to the leading side in a sheet width direction, and then is stopped. Further, in a case where the sheet P is conveyed by the conveying roller pair 20, the leading side in the sheet width direction of the sheet P abuts on the first contact surfaces 29*a* of the plurality of first shutter members 24*a* sequentially arranged in the width direction, and forms a loop (bending) in the conveying guide 30. Therefore, the leading edge of the sheet P is arranged along the plurality of first contact surfaces 29*a* and thus the skew feeding of the sheet P is corrected.

Thereafter, the loop becomes larger, but is regulated by the conveying guide 30, and thus the sheet P presses the first contact surface 29*a* by the rigidity (stiffness) of the sheet P. When a pressing force f3 of the sheet P exceeds the urging force f1 of the urging spring, as illustrated in FIGS. 5A to 6B, the plurality of first shutter members 24*a* is integrally rotated in a direction of arrow R, and starts to move from the contact position to the retracting position illustrated in FIG. 6B. Further, the retracting position mentioned herein is a position at which the leading edge of the first contact surface 29*a* is on standby while abutting on the surface of the conveyed sheet P.

At this time, the leading edge of the sheet P is regulated by a roller surface of the driving roller 25 and the guide surface 24*c* of the second shutter member 24*b* in order not to be escaped from the first contact surface 29*a*, and conveyed toward the nip portion N. Further, since the second shutter member 24*b* is positioned (offset) on a side near the driven roller 27 from the nip line N1 as illustrated in FIG. 6A, the second shutter member 24*b* serves as a guide, and does not hinder the conveyance of the sheet P.

In process of the conveyance, the sheet P enters the nip portion N of the register roller pair 23 in the state of being corrected in skew feeding (the leading edge of the sheet P is substantially parallel with a rotational axis of the register driven shaft 28), and conveyed to the secondary transfer portion by the register roller pair 23. The secondary transfer portion is a portion where the secondary transfer roller 22 is pressed to the intermediate transfer belt 17.

Figure 7A:
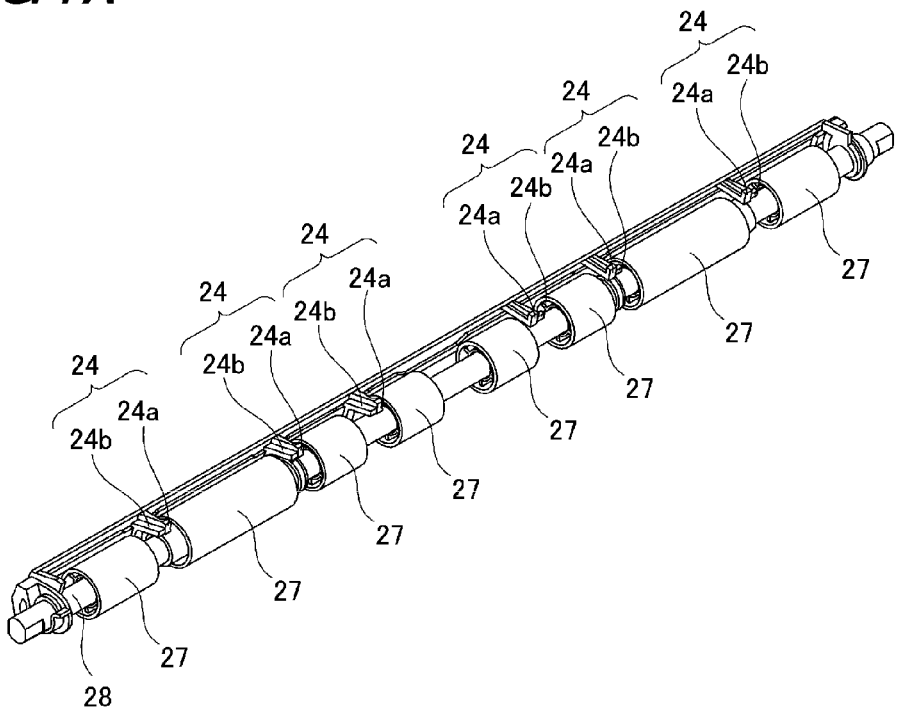
FIGS. 7A and 7B are perspective views illustrating a leading edge locking position of the first shutter member and the second shutter member.
Figure 7B:
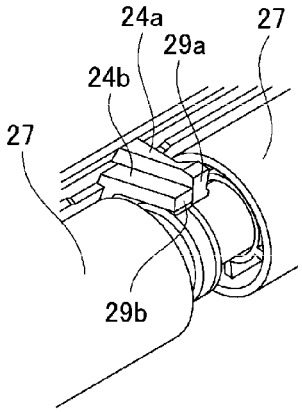
Figure 8:
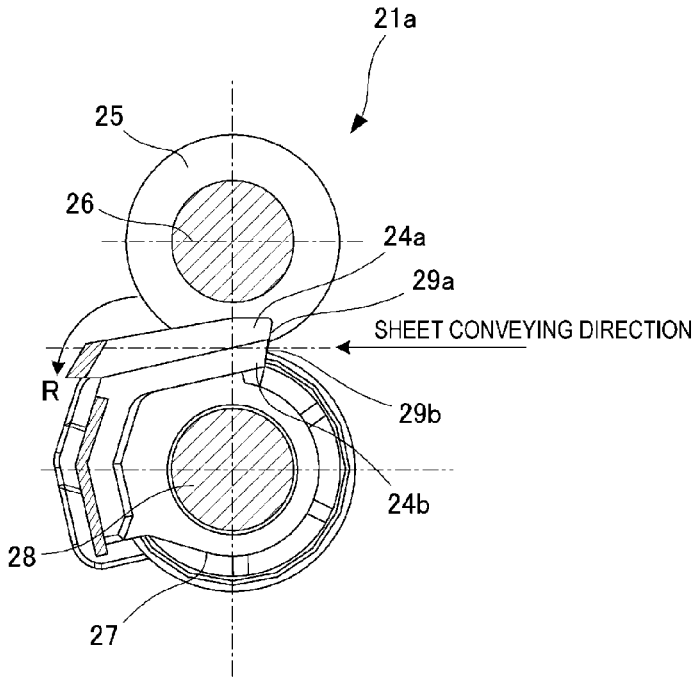
FIG. 8 is a cross-sectional view illustrating the leading edge locking position of the first shutter member and the second shutter member.
Figure 9A:
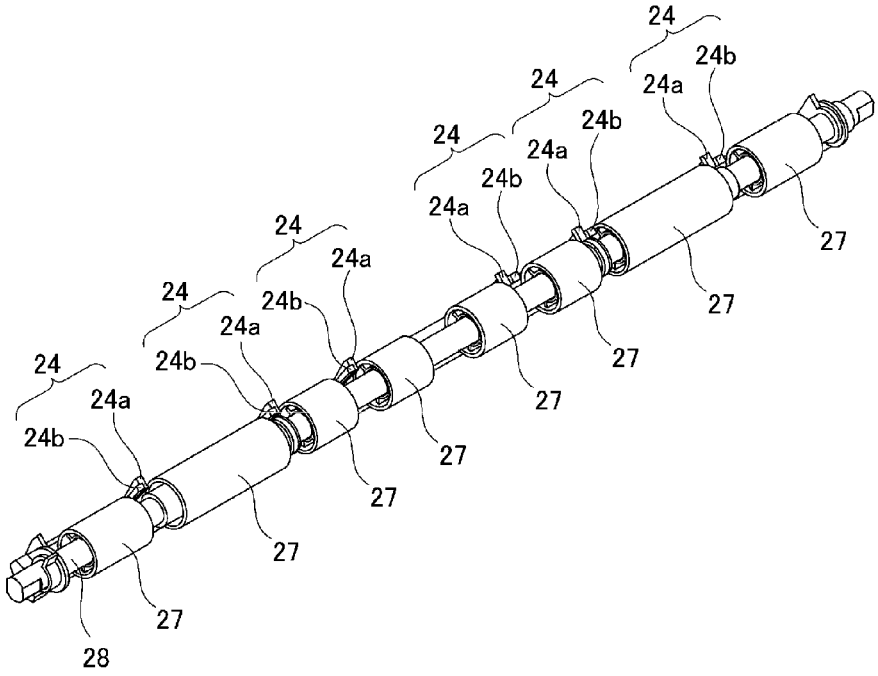
FIGS. 9A and 9B are perspective views illustrating a state in which the first shutter member and the second shutter member move to the retracting positions.
Figure 9B:
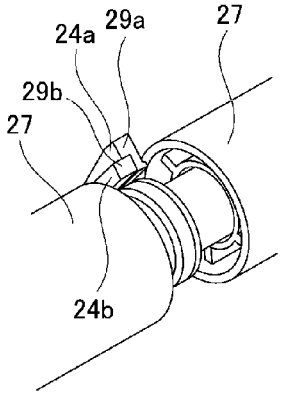
Figure 10:
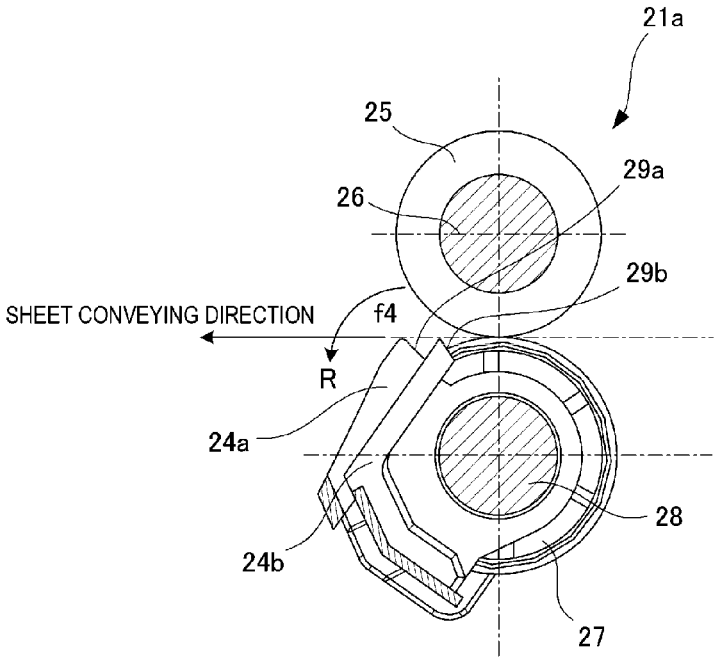
FIG. 10 is a cross-sectional view illustrating a state in which the first shutter member and the second shutter member move to the retracting positions.

Next, the skew correction operation of the high rigidity sheet P will be described with reference to FIG. 4 and FIGS. 7A to 10. FIGS. 7A and 7B are perspective views illustrating a leading edge locking position of the first shutter member 24*a* and the second shutter member 24*b*. FIG. 8 is a cross-sectional view illustrating the leading edge locking position of the first shutter member 24*a* and the second shutter member 24*b*. FIGS. 9A and 9B are perspective views illustrating a state in which the first shutter member 24*a* and the second shutter member 24*b* move to the retracting positions. FIG. 10 is a cross-sectional view illustrating a state in which the first shutter member 24*a* and the second shutter member 24*b* move to the retracting positions.

In a case where the sheet P fed to the sheet conveying portion 21 is a thick sheet having a rigidity equal to or more than that of plain paper (a basis weight of 100 g/m$^2$), when the sheet P conveyed by the conveying roller pair 20 passes through the lower conveyance guide 30*b*, the elastic sheet M is elastically deformed by the thickness and weight of the sheet P. Therefore, the sheet P is conveyed toward the second contact surface 29*b* of the second shutter member 24*b*, and abuts on the second contact surface 29*b*.

Herein, the urging force f2 of the second shutter member 24*b* at the initial position is set to make the second shutter member 24*b* rotate by the pressing force of the sheet P before the sheet P reaches an identified loop amount. Therefore, when the sheet P is further conveyed after the leading edge of the sheet P abuts on the second contact surface 29*b*, the leading edge of the sheet P makes the second shutter member 24*b* rotate in a direction of arrow R illustrated in FIG. 4 in a state where the sheet P does not reach the predetermined loop amount.

Then, when the leading edge of the sheet P reaches the first contact surface 29*a* of the first shutter member 24*a* disposed over the nip line N1, as illustrated in FIGS. 7A to 8, the leading edge of the sheet P is stopped by the first contact surface 29*a* and the second contact surface 29*b*. At this time, the pressing force of the sheet P before the loop is formed is set not to make the first shutter member 24*a* and the second shutter member 24*b* rotate against the urging forces f1 and f2 of the first shutter member 24*a* and the second shutter member 24*b*.

When the sheet P is further conveyed, the leading side of the sheet P in the width direction of the sheet P abuts on the plurality of first contact surfaces 29*a* and the plurality of second contact surfaces 29*b* sequentially arranged in the width direction, and forms a loop (bending) in the conveying guide 30. Therefore, the skew feeding of the sheet P is corrected.

Thereafter, the loop becomes larger, but is regulated by the conveying guide 30, and thus the sheet P presses the first contact surface 29*a* and the second contact surface 29*b* by the rigidity (stiffness) of the sheet P. Herein, the urging forces f1 and f2 of the first shutter member 24*a* and the second shutter member 24*b* located at the leading edge locking position are set such that the first shutter member 24*a* and the second shutter member 24*b* rotate when the pressing force of the sheet P pressing the first contact surface 29*a* and the second contact surface 29*b* becomes equal to or larger than f4 (>f1+f2).

Therefore, when the pressing force f4 of the sheet P exceeds the urging force, the plurality of first shutter members 24*a* and the plurality of second shutter members 24*b* integrally rotate in the direction of arrow R as illustrated in FIGS. 7A to 9B, and start to move from the leading edge locking position to the retracting position. Further, the retracting position mentioned herein is a position at which the leading edges of the first contact surface 29*a* and the second contact surface 29*b* are on standby while abutting on the surface of the conveyed sheet P as illustrated in FIG. 10.

In process of the conveyance, the sheet P enters the nip portion N of the register roller pair 23 in the state of being corrected in skew feeding (the leading edge of the sheet P is substantially parallel with the rotational axis of the register driven shaft 28), and conveyed by the register roller pair 23.

Herein, the rotational axis of the register driven shaft 28 is disposed in parallel with the rotational axis of the secondary transfer roller 22 illustrated in FIG. 1. Therefore, the sheet P, which abuts on the plurality of skew correction portions 24 to be parallel with the rotational axis of the register driven shaft 28, is conveyed to the secondary transfer portion in a state having no skew feeding.

As described above, in the printer according to the embodiment, the first shutter member 24*a* and the second shutter member 24*b* are disposed such that the first contact surface 29*a* is disposed over the nip line N1 and the second contact surface 29*b* is offset toward the rotation shaft from the nip line N1. Therefore, it is possible to make the low rigidity sheet P abut only on the first contact surface 29*a*, and the high rigidity sheet P abut on the first contact surface 29*a* and the second contact surface 29*b*. In addition, the first shutter member 24*a* and the second shutter member 24*b* are provided to be applied with an urging force (rotation force) according to the rigidity of the sheet P. Therefore, in a case where the rigidity of the sheet P is low, the skew feeding can be corrected only by the first shutter member 24*a*, and in a case where the rigidity of the sheet P is high, the skew feeding can be corrected by the first shutter member 24*a* and the second shutter member 24*b*.

In addition, when the thick sheet (the high rigidity sheet) is conveyed, the conveying guide 30 is provided with the elastically-deformable elastic sheet M disposed on a side near the driven roller 27. Therefore, in a case where the thin sheet (the low rigidity sheet) is conveyed, the conveying guide 30 can guide the sheet to the first contact surface 29*a*, and in a case where the thick sheet (the high rigidity sheet) is conveyed, the conveying guide 30 can guide the sheet to the second contact surface 29*b*.

With this configuration, it is possible to correct the skew feeding of the sheet with simplicity and ease regardless of the type of the sheet. In other words, a good skew correction performance can be obtained regardless of the rigidity (stiffness) of the sheet P. Therefore, a sheet-type handling capability is widened, so that an image geometrical characteristic of the sheet P can be stabilized.

In addition, since there is no need to change the work according to the type of the sheet, a user eliminates a complicated setting operation and a troublesome select operation and thus selection error and setting error are prevented. Therefore, it is possible to prevent usability from being degraded. In addition, the sheet to be contained in the sheet cassette 18 is not limited.

Furthermore, according to the printer according to the embodiment, the second shutter member 24*b* is offset toward the rotation shaft from the nip line N1, and includes the guide surface through which the sheet P can be guided to the nip portion N. Therefore, the thin sheet can be easily carried, and the paper jam can be reduced.

<Second Embodiment>

Next, a printer according to a second embodiment of the invention will be described with reference to FIGS. 11 to 13. The printer according to the second embodiment is different from the first embodiment in the configuration of the conveying guide. Therefore, the description herein will be made about the conveying guide, and the other configurations will be denoted with the same symbols and the descriptions thereof will not be repeated.

Generally, in the sheet P, a bending pattern (so-called curling) appears in the end portion depending on the type (for example, paper type) of the sheet P, an environmental change, and a load on the conveying roller. For example, in a case where the bending pattern appears in the leading edge of the sheet P, according to the shape and the size of the bending pattern, a degree of irregularity appearing in a contact portion at the leading edge of the sheet P with respect to the first contact surface 29*a* and the second contact surface 29*b* tends to increase. Then, in the embodiment, the sheet P is guided while being applied by a force (correction) to the curling portion by driving the conveying guide, so that the sheet P stably abuts on the first contact surface 29*a* or the second contact surface 29*b*. Hereinafter, the detailed description will be made.

Figure 11:
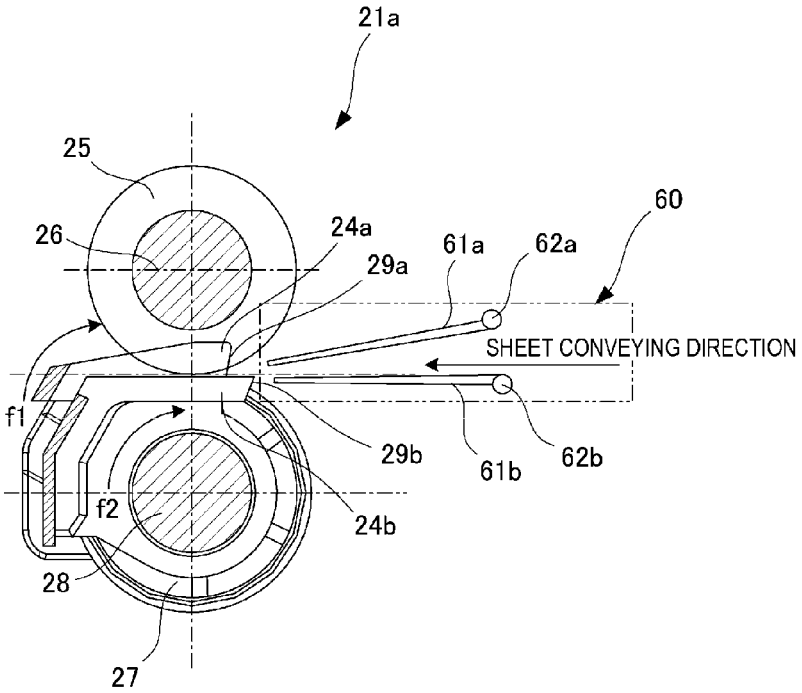
FIG. 11 is a cross-sectional view illustrating an initial position of a conveying guide according to a second embodiment.

FIG. 11 is a cross-sectional view illustrating an initial position of a conveying guide 60 according to the second embodiment. FIG. 12 is a block diagram illustrating a configuration for controlling the conveying guide 60 according to the second embodiment. FIG. 13 is a cross-sectional view illustrating a state in which the conveying guide 60 according to the second embodiment moves to a thick sheet guiding position.

As illustrated in FIG. 11, the conveying guide 60 includes an upper conveyance guide (a conveying guide member) 61*a* which is provided on a side near the driving roller 25, and a lower conveyance guide (a conveying guide member) 61*b* which is provided on a side near the driven roller 27. The upper conveyance guide 61*a* is configured to be rotatable about the rotation shaft 62*a* substantially parallel to the register driving shaft 26, and the lower conveyance guide 61*b* is configured to be rotatable about the rotation shaft 62*b* substantially parallel to the register driven shaft 28, so that the guide position of the sheet P can be adjusted.

Figure 12:
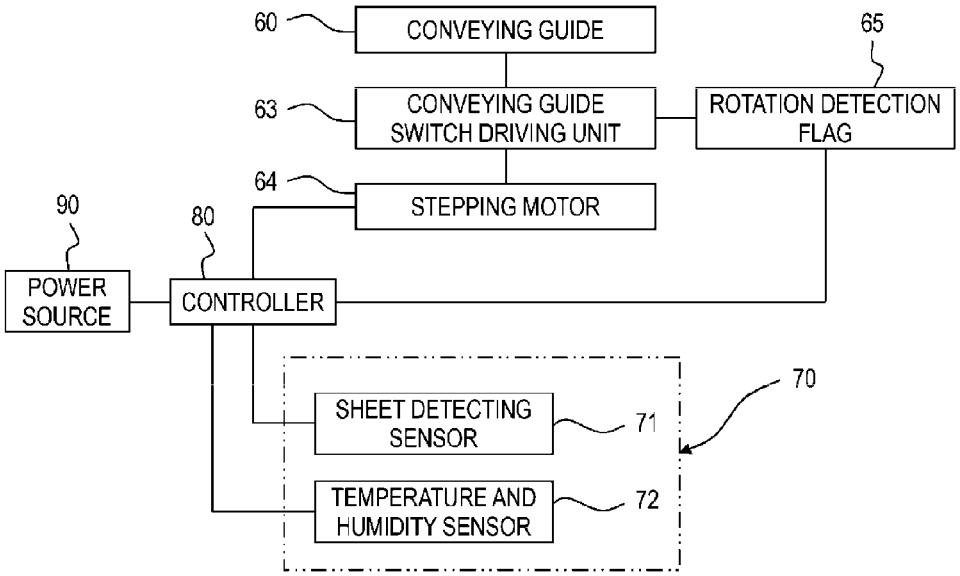
FIG. 12 is a block diagram illustrating a configuration for controlling the conveying guide according to the second embodiment.
Figure 13:
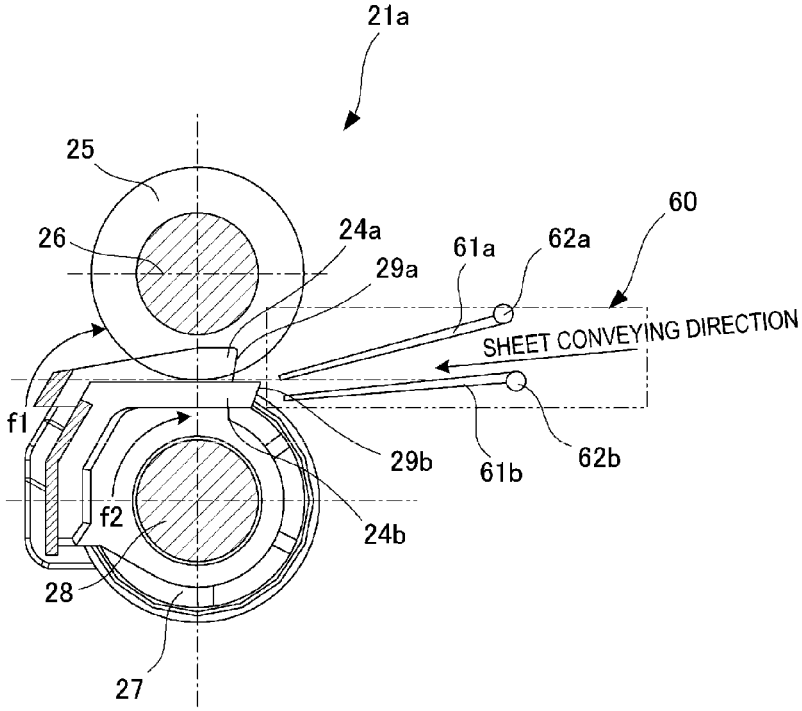
FIG. 13 is a cross-sectional view illustrating a state in which the conveying guide according to the second embodiment moves to a thick sheet guiding position.

As illustrated in FIG. 12, the upper conveyance guide 61*a* and the lower conveyance guide 61*b* are connected to a conveying guide switch driving unit 63, and the conveying guide switch driving unit 63 is connected to a stepping motor 64. The stepping motor 64 is connected to the controller 80, and a detection unit (an information acquisition unit) 70 and a power source 90 are connected to the controller 80. The detection unit 70 according to the embodiment is configured to include a sheet detecting sensor 71 and a temperature and humidity sensor 72. The sheet detecting sensor 71 can detect (acquire) information such as the type (rigidity) and the size of the sheet P, and the temperature and humidity sensor 72 detects temperature and humidity. Further, the reason why the temperature and humidity sensor 72 is provided is that the sheet P has the same basis weight but may be different in rigidity according to the humidity.

When the sheet P having a rigidity relatively lower than the plain paper (a basis weight of 100 g/m$^2$) is detected by the sheet detecting sensor 71 and the temperature and humidity sensor 72, the controller 80 calculates a severe conveyance condition on the curling at the leading edge in the case of the thin sheet. Then, based on the calculated conveyance condition, the controller 80 sends a signal to the stepping motor 64 while detecting a position of a rotation detection flag 65. Specifically, the controller 80 transfers a driving force through the conveying guide switch driving unit 63 to make the upper conveyance guide 61*a* rotate such that the guide surface of the upper conveyance guide 61*a* guides the sheet P toward the nip portion N of the register roller pair 23. Similarly, the controller 80 makes the lower conveyance guide 61*b* rotate such that an inter-guide gap with respect to the upper conveyance guide 61*a* is constricted as it goes in the sheet conveying direction. Further, the position of the conveying guide 60 in this case becomes the initial position.

With this configuration, the leading edge of the sheet P having the curling at the leading edge stably abuts on the first contact surface 29*a* of the first shutter member 24*a* immediately before the sheet P enters the nip portion N of the register roller pair 23, so that the sheet P can be stopped at the first contact surface 29*a*.

On the other hand, when the sheet P having a relatively high rigidity equal to or more than the plain paper (a basis weight of 100 g/m$^2$) is detected by the sheet detecting sensor 71 and the temperature and humidity sensor 72, the controller 80 calculates the severe conveyance condition on the curling at the leading edge in the case of the thick sheet. Then, based on the calculated conveyance condition, the controller 80 sends a signal to the stepping motor 64 while detecting a position of the rotation detection flag 65. Specifically, the controller 80 transfers a driving force through the conveying guide switch driving unit 63 to make the lower conveyance guide 61*b* rotate such that the guide surface of the lower conveyance guide 61*b* faces the second contact surface 29*b* of the second shutter member 24*b* from the initial position. Similarly, the controller 80 makes the upper conveyance guide 61*a* rotate such that an inter-guide gap with respect to the lower conveyance guide 61*b* is constricted as it goes in the sheet conveying direction.

With this configuration, the leading edge of the sheet P having the curling at the leading edge stably abuts on the second contact surface 29*b* of the second shutter member 24*b* immediately before the sheet P enters the nip portion N of the register roller pair 23, so that the sheet P can be stopped at the first contact surface 29*a* and the second contact surface 29*b*.

As described above, with the printer according to the embodiment, the good skew correction performance can be obtained regardless of the rigidity (stiffness) of the sheet P and the curling at the leading edge, a sheet-type handling capability is widened, and an image geometrical characteristic of the sheet P can be stabilized.

Hitherto, the description has been made about the embodiments of the invention, but the invention is not limited to the above-mentioned embodiments. In addition, the advantages described in the embodiments of the invention are merely exemplified as best advantages which can be obtained from the invention, and the advantages of the invention are not limited to the description of the embodiments of the invention.

In addition, the embodiments have been described using a printer of an electrophotographic system, but the invention is not limited thereto. For example, the invention can be employed to an inkjet printer (an image forming apparatus) in which an image is formed on a sheet by ejecting ink liquid from nozzles.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-000888, filed Jan. 7, 2014, which is hereby incorporated by reference herein in its entirety.

What is claimed is:

1. A sheet conveying apparatus comprising:

a rotator pair which includes a nip portion to nip and convey a sheet conveyed by a sheet conveying portion;

a first moving portion which includes a first contact surface abutting on the sheet on an upstream of the nip portion of the rotator pair in a sheet conveying direction, the first contact surface moving while being pressed by the sheet;

a second moving portion which includes a second contact surface abutting on the sheet on the upstream of the nip portion of the rotator pair in the sheet conveying direction, the second contact surface moving while being pressed by the sheet; and a guide portion which guides a leading edge of the sheet conveyed by the sheet conveying portion selectively to the first contact surface of the first moving portion and the second contact surface of the second moving portion.

2. The sheet conveying apparatus according to claim 1, wherein the guide portion guides the sheet conveyed by the sheet conveying portion such that in a case where a rigidity of the sheet is lower than a predetermined rigidity, the leading edge of the sheet is made to abut on the first contact surface, and in a case where the rigidity of the sheet is higher than the predetermined rigidity, the leading edge of the sheet is made to abut on the first contact surface and the second contact surface.

3. The sheet conveying apparatus according to claim 1, wherein the second contact surface of the second moving portion is positioned on the upper stream side in the sheet conveying direction from the first contact surface.

4. The sheet conveying apparatus according to claim 1, wherein the first moving portion and the second moving portion are disposed such that the sheet of which the leading edge abuts on the first contact surface does not abut on the second contact surface until the sheet is nipped at the nip portion of the rotator pair, and the sheet of which the leading edge abuts on the second contact surface abuts on the first contact surface until the sheet is nipped at the nip portion of the rotator pair.

5. The sheet conveying apparatus according to claim 1, wherein the guide portion includes an elastic sheet which is disposed on a side near the second moving portion from a nip line of the rotator pair and of which the downstream end in the sheet conveying direction is positioned near the nip line, and a guide member which is disposed on a side opposite to the elastic sheet with respect to the nip line and of which the downstream end in the sheet conveying direction is positioned near the nip line, and the guide portion guides the sheet to the first contact surface along the nip line in a case where the rigidity of the sheet conveyed by the sheet conveying portion is lower than a predetermined rigidity, and guides the sheet to the second contact surface by elastically deforming the elastic sheet in a case where the rigidity of the sheet is higher than the predetermined rigidity.

6. The sheet conveying apparatus according to claim 5, wherein the elastic sheet is configured to be elastically deformed by a weight of the sheet of which the rigidity is higher than the predetermined rigidity.

7. The sheet conveying apparatus according to claim 1, wherein the guide portion includes a conveying guide member which adjusts a guide position with respect to the rotator pair, and an information acquisition unit which acquires information of the sheet conveyed by the sheet conveying portion, and the conveying guide member switches the guide positions according to a state of the sheet acquired by the information acquisition unit.

8. The sheet conveying apparatus according to claim 7, wherein the information of the sheet acquired by the information acquisition unit is a rigidity of the sheet.

9. The sheet conveying apparatus according to claim 1, wherein the first contact surface is positioned to cross over a nip line of the rotator pair, and the second contact surface is positioned on a side near a rotation shaft from the nip line.

10. The sheet conveying apparatus according to claim 1, the second moving portion includes a surface on a side near a nip line which serves as a guide surface substantially parallel to the nip line when the second contact surface is positioned at a contact position where the sheet abuts.

11. The sheet conveying apparatus according to claim 1, wherein the first moving portion includes a first urging portion which applies a force to a contact position where the leading edge of the sheet abuts, and the second moving portion includes a second urging portion which applies a force to the contact position where the leading edge of the sheet abuts.

12. The sheet conveying apparatus according to claim 1, wherein a skew feeding of the sheet is corrected by making the sheet abut on at least one of the first moving portion and the second moving portion.

13. The sheet conveying apparatus according to claim 7, wherein the information acquisition unit includes a temperature and humidity sensor.

14. The sheet conveying apparatus according to claim 1, wherein the first moving portion and the second moving portion are supported to be freely rotated.

15. The sheet conveying apparatus according to claim 4, wherein the rotator pair is arranged such that, while the first moving portion is moved by being pushed by the leading edge of the conveyed sheet that is abutted against the first contact surface, the leading edge of the sheet is nipped by the nip portion, and while the second moving portion is moved by being pushed by the leading edge of the conveyed sheet that is abutted against the second contact surface, the leading edge of the sheet is nipped by the nip potion.

16. An image forming apparatus comprising:

an image forming portion which forms an image on a sheet; and a sheet conveying apparatus which conveys the sheet to the image forming portion, wherein the sheet conveying apparatus includes a rotator pair which includes a nip portion to nip and convey a sheet conveyed by a sheet conveying portion;

a first moving portion which includes a first contact surface abutting on the sheet on an upstream of the nip portion of the rotator pair in a sheet conveying direction, the first contact surface moving while being pressed by the sheet;

a second moving portion which includes a second contact surface abutting on the sheet on the upstream of the nip portion of the rotator pair in the sheet conveying direction, the second contact surface moving while being pressed by the sheet; and a guide portion which guides a leading edge of the sheet conveyed by the sheet conveying portion selectively to the first contact surface of the first moving portion and the second contact surface of the second moving portion.

17. The image forming apparatus according to claim 16, wherein the guide portion guides the sheet conveyed by the sheet conveying portion such that in a case where a rigidity of the sheet is lower than a predetermined rigidity, the leading edge of the sheet is made to abut on the first contact surface, and in a case where the rigidity of the sheet is higher than the predetermined rigidity, the leading edge of the sheet is made to abut on the first contact surface and the second contact surface.

18. The image forming apparatus according to claim 16, wherein the second contact surface of the second moving portion is positioned on the upper stream side in the sheet conveying direction from the first contact surface.

19. The image forming apparatus according to claim 16, wherein the first moving portion and the second moving portion are disposed such that the sheet of which the leading edge abuts on the first contact surface does not abut on the second contact surface until the sheet is nipped at the nip portion of the rotator pair, and the sheet of which the leading edge abuts on the second contact surface abuts on the first contact surface until the sheet is nipped at the nip portion of the rotator pair.

20. The image forming apparatus according to claim 16, wherein the first moving portion includes a first urging portion which applies a force to a contact position where the leading edge of the sheet abuts, and the second moving portion includes a second urging portion which applies a force to the contact position where the leading edge of the sheet abuts.

* * * * *